US005560719A

United States Patent [19]

Ballard et al.

[11] Patent Number: 5,560,719

[45] Date of Patent: Oct. 1, 1996

[54] POSITIONING MECHANISM FOR A TYPEWRITER DISPLAY PANEL

[75] Inventors: Rodney R. Ballard, Memphis; Kazuki Ohashi, Cordova, both of Tenn.

[73] Assignee: Brother International Corporation, Somerset, N.J.

[21] Appl. No.: 368,352

[22] Filed: Jan. 4, 1995

[51] Int. Cl.[6] ..... B41J 3/46

[52] U.S. Cl. ..... 400/83; 400/690.4

[58] Field of Search ..... 400/690.4, 691, 400/692, 693, 83; 361/681

[56] References Cited

U.S. PATENT DOCUMENTS

| | | | |
|---|---|---|---|
| 4,739,316 | 4/1988 | Yamaguchi et al. | 400/690.4 |
| 5,085,394 | 2/1992 | Torii | 361/681 |
| 5,257,164 | 10/1993 | Perez et al. | 361/681 |
| 5,291,370 | 3/1994 | Yanagisawa et al. | 361/681 |
| 5,390,075 | 2/1995 | English et al. | 361/681 |

*Primary Examiner*—Edgar S. Burr
*Assistant Examiner*—Steven S. Kelley
*Attorney, Agent, or Firm*—Oliff & Berridge

[57] ABSTRACT

A mechanism for preventing rattling between a display cover that is pivotable about a chassis includes a first engagement surface associated with a display cover, and a second engagement surface associated with a chassis, the first and second engagement surfaces being slidably rotatable to allow the display cover to pivot about the chassis in a rotational range defined between open and closed positions. The mechanism includes a device for substantially preventing relative axial movement between the first and second engagement surfaces in the rotatable range. An elongated arcuate segment mounted on the first engagement surface mates with a corresponding elongated slot formed on the second engagement surface. The slot may be sized and dimensioned so as to constitute a stop for the positioning projection so that damage can be prevented that would otherwise occur between the liquid crystal display panel and the keyboard.

13 Claims, 5 Drawing Sheets

POSITIONING MECHANISM FOR A TYPEWRITER DISPLAY PANEL

BACKGROUND OF THE INVENTION

1. Field of the Invention

This invention relates to display panels that are rotatably mounted about a chassis and, in particular, a positioning element for allowing rotation but preventing axial movement between the display panel and the main chassis.

2. Description of the Related Art

Printing devices such as typewriters or word processors have a main chassis or a body about which a display panel is rotatably secured. The display panel is generally loosely placed within a frame member of the main chassis so that the user may easily tilt the display panel to the desired viewing position.

During operation, the user sets the display panel at the desired viewing position and begins typing. After the viewer has confirmed on the display panel that the typed material has been accurately represented, a printing assembly, such as an ink jet, a thermal printer or an impact element, begins printing the typed characters onto a recording medium. At such time, however, vibration from the printing assembly causes the display panel and the chassis to rattle, thus causing an undesirable noise, low reliability and shortened life expectancy of the rattling parts.

One solution to solving the rattling problem is to manufacture the engaging parts of the display panel and the chassis to have a very high manufacturing tolerance. However, because the display panel and the chassis are manufactured in a molding process and are relatively large in size, it is difficult and expensive to manufacture the display panel and the chassis to have high tolerances. Moreover, small errors in manufacturing the display panel and the chassis may cause the display panel to be fit into the chassis very tightly, and make it very difficult to rotate the display panel with respect to the chassis when it is desirable to change the viewing position of the display panel.

Other solutions to solving the rattling problem have also been proposed. For example, one solution is to provide washer members to the hinges that rotatably connect the display panel to the chassis. In addition, another prior art solution is to provide a spring member between the display panel and the chassis to constantly bias the display panel against the chassis. These solutions also suffer from low reliability and require additional parts and commensurate manufacturing and assembling steps.

SUMMARY OF THE INVENTION

This invention thus overcomes the above and other deficiencies and disadvantages of the conventional hinge connections for display panels, by providing a highly reliable positioning mechanism between the display panel and the chassis without increasing costs.

According to a first aspect of the present invention, there is provided an typewriter comprising chassis and a display panel. The display panel is pivotably connected to the chassis such that the display panel is rotatable between first and second positions that define a rotatable range. A positioning element, which is substantially centrally located along and between the display panel and the chassis, is adapted to substantially prevent relative axial movement between the display panel and the upper chassis during rotation in the rotatable range.

The positioning element may comprise a projection mounted on the chassis and a slot provided within the display panel.

According to a second aspect of the present invention, there is provided a positioning mechanism for use with a display panel that is rotatably mounted to a body of a word processor. The positioning mechanism includes a first surface formed on the display panel, a second surface formed on the body, the first and second surfaces being relatively rotatable, a positioning projection formed on the first surface, and a slot formed within the second surface. The first surface is rotatable with respect to the second surface thereby causing the positioning projection to travel along the slot, the positioning projection remaining disposed within the slot during an entire rotational range of angular movement between open and a closed positions.

The positioning mechanism may further comprise an axis, the first surface and the second positioning projection rotating about the axis. In addition, the positioning mechanism may include a pin and slot assembly located at each end of the display panel which rotates about the axis. Furthermore, the positioning projection may have a width equal to about 3.0 mm and the slot may have a width equal to about 3.1 mm.

According to a third aspect of the present: invention, there is provided a mechanism for positioning and guiding a display cover that is pivotable about a chassis. The mechanism comprises a pin associated with each end of the display cover, a pin receiving hole associated with each side of the chassis, the pins and the pin receiving holes being slidably rotatable so as to allow the display cover to pivot about the chassis between a rotatable range defined by first and second angular positions, and a device for substantially preventing relative axial movement between the pins and the pin receiving holes in the rotatable range. The device for substantially preventing axial movement is substantially centrally located along and between the display cover and the chassis.

These and other aspects and advantages of the present invention are described in or apparent from the following detailed description of preferred embodiments.

BRIEF DESCRIPTION OF THE DRAWINGS

A preferred embodiment of the present invention will be described in detail with reference to the accompanying drawings, wherein.

DETAILED DESCRIPTION OF PREFERRED EMBODIMENTS

A preferred embodiment of the invention will be described below with reference to the accompanying drawings.

Figure 1:
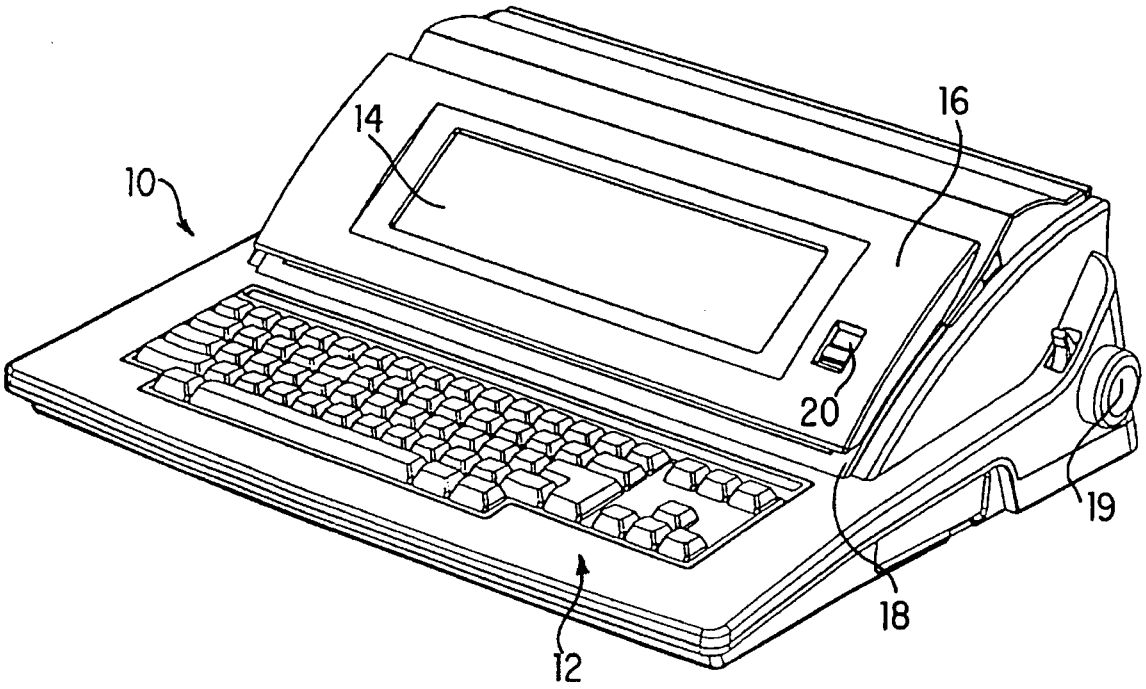
FIG. 1 is an isometric view of a typewriter generally showing the keyboard and the liquid crystal display.

As shown in FIG. 1, an ink jet typewriter 10 or word processor of the present invention comprises a keyboard 12 and a liquid crystal display 14 for displaying typed text before it is printed on a recording medium. The liquid crystal display 14 is mounted on a display panel 16 that is pivotable about a chassis member or a body 18 to various set positions according to user preference. The display panel 16 includes a control mechanism 20 for varying the light intensity or contrast of the liquid crystal display. The typewriter 10 may also include all necessary mechanisms found on conventional machines, such as a manual paper advancement knob 19.

Figure 2:
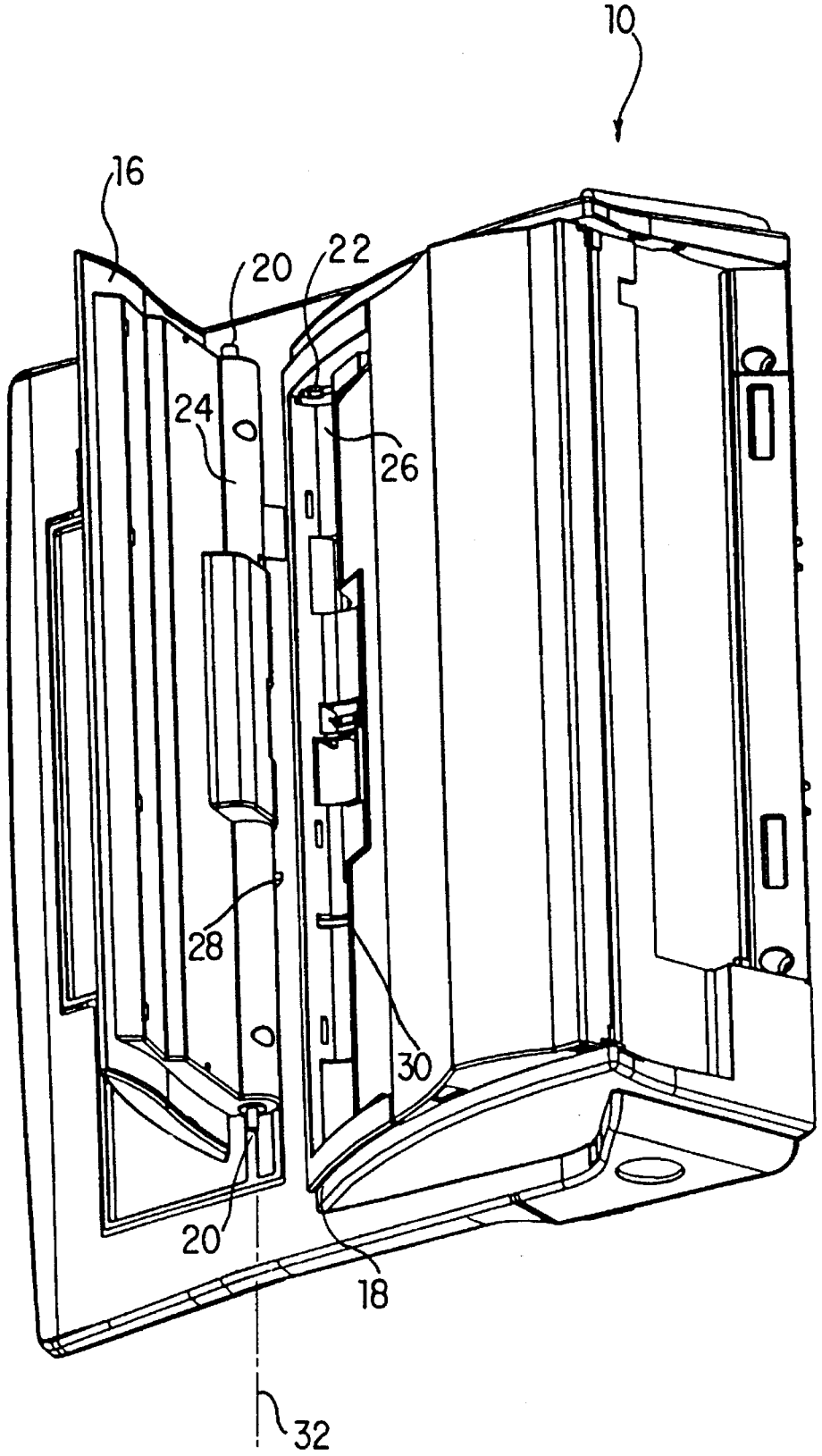
FIG. 2 is a top isometric view showing the projection and the slot.

FIG. 2 is a top isometrical view that shows the display panel 16 disassembled from the chassis 18. The display panel 16 includes a hinge pin 20 located at each end of the display panel 16. Each hinge pin 20 is adapted to be received with respective hinge pin receiving holes 22 located at each end of the upper panel 18. Only one of the hinge pin holes 22 is shown in FIG. 2, the other being hidden by the upper chassis 18. Of course, the upper chassis 18 could be provided with the hinge pins 20 and the display panel could be provided with hinge pin receiving holes 22, depending on manufacturing needs and assembly preference.

The display panel 16 also includes, between hinge pins 20, a first surface 24 that is relatively rotatable with respect to a second surface 26 formed on the upper chassis 18. In addiction, the first surface 24 is provided with a positioning projection 28 while the second surface 26 is provided with a slot 30.

During operation, the display panel 16 rotates about an axis 32 that passes through the center of both hinge pins 20. In addition, the first surface 24 and the projection 28 rotate about axis 32 when the display panel 16 is rotated between first or open and second or closed positions that define a rotational range of the display panel 16. The closed position corresponds to the position of the display panel shown in FIG. 1 while the open positions correspond to any position that is not closed. The projection 28 remains within the slot 30 throughout the entire rotational range of movement of the display panel 16 with respect to the chassis 18. With such an arrangement, axial movement between the first surface and the second surface 26 is substantially prevented.

Figure 3:
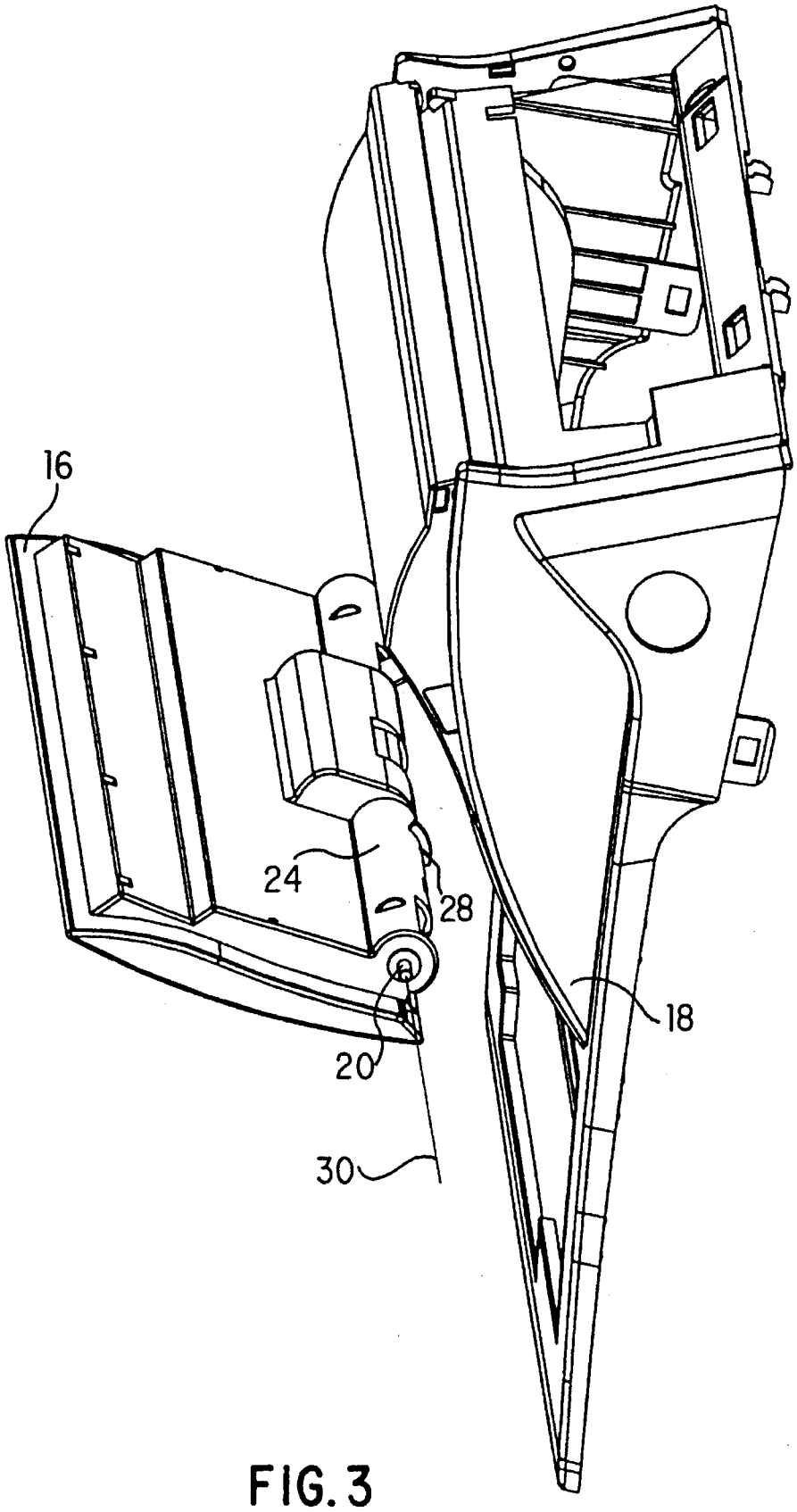
FIG. 3 is a side isometric view showing the upper chassis and the display panel in a detached condition.

FIG. 3 shows the display panel 16 and the upper chassis 18 in the disassembled state. While slot 30 is not shown in FIG. 3, the projection 28 is shown in more detail than is shown in FIG. 2. The projection 28 has a shape of an elongated arcuate segment that has an outer surface that generally conforms to the shape of the first surface 24. The projection 28 has a shape that corresponds to the shape of slot 30, which is shown in more detail in FIG. 4.

Figure 4:
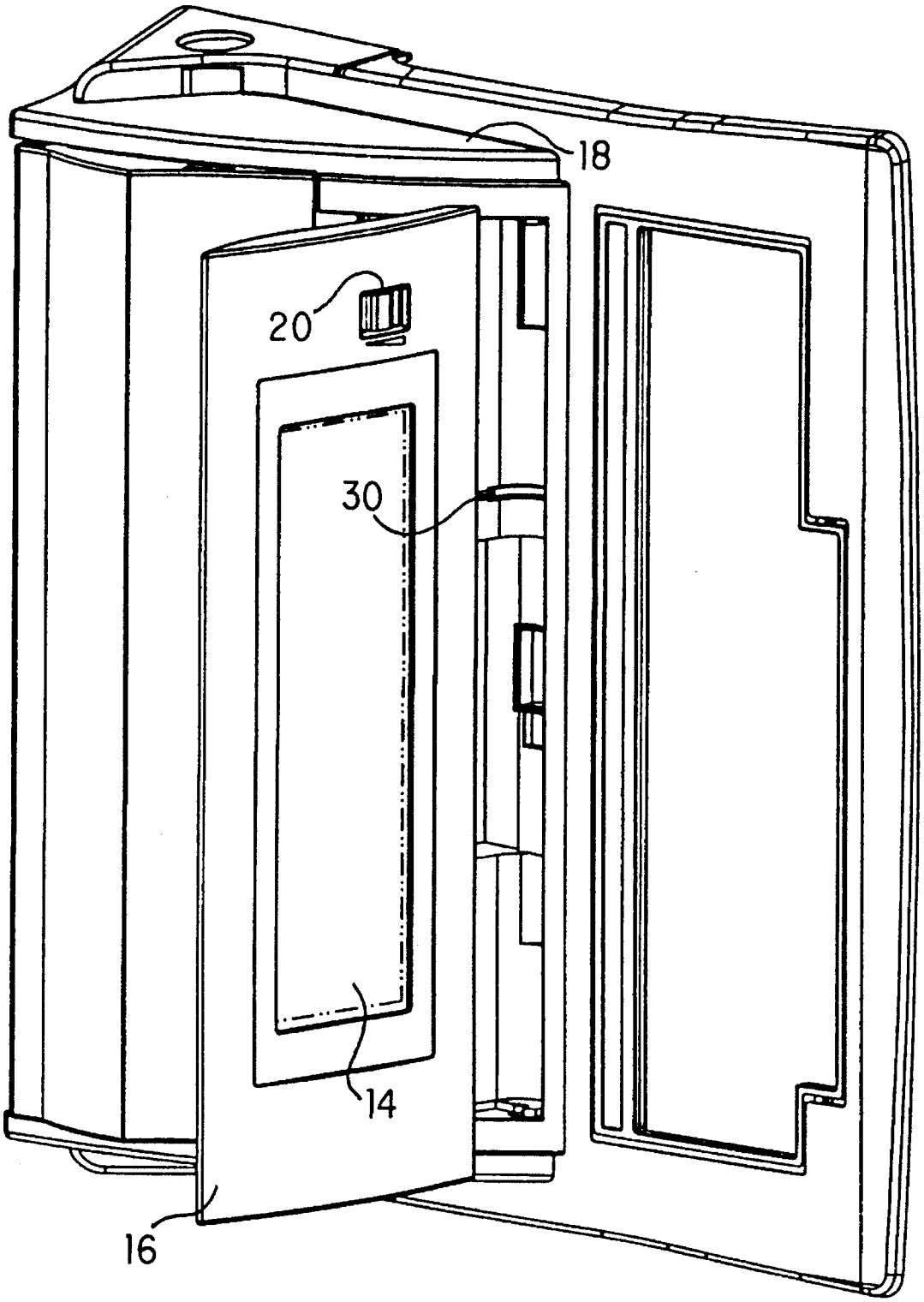
FIG. 4 is a top view showing a front of the panel and more details of the slot.

FIG. 4 is a top isometric view of the disassembled chassis 18 and display panel 16. As shown in FIG. 4, the slot also includes an elongated arcuate shape. The length of the slot 30 is dimensioned so as to accommodate the projection 28 along the entire rotatable range of the display panel 16 with respect to the chassis 18. Moreover, the size of the slot 30 can be dimensioned such that the maximum open position of the display panel can be defined. In this event, an end portion of the projection 28 is made to engage an end wall of slot 30 thereby avoiding damage that might otherwise occur by rotating the display panel beyond the maximum open position to such an extent that the LCD 14 contacts the keyboard 12.

Figure 5:
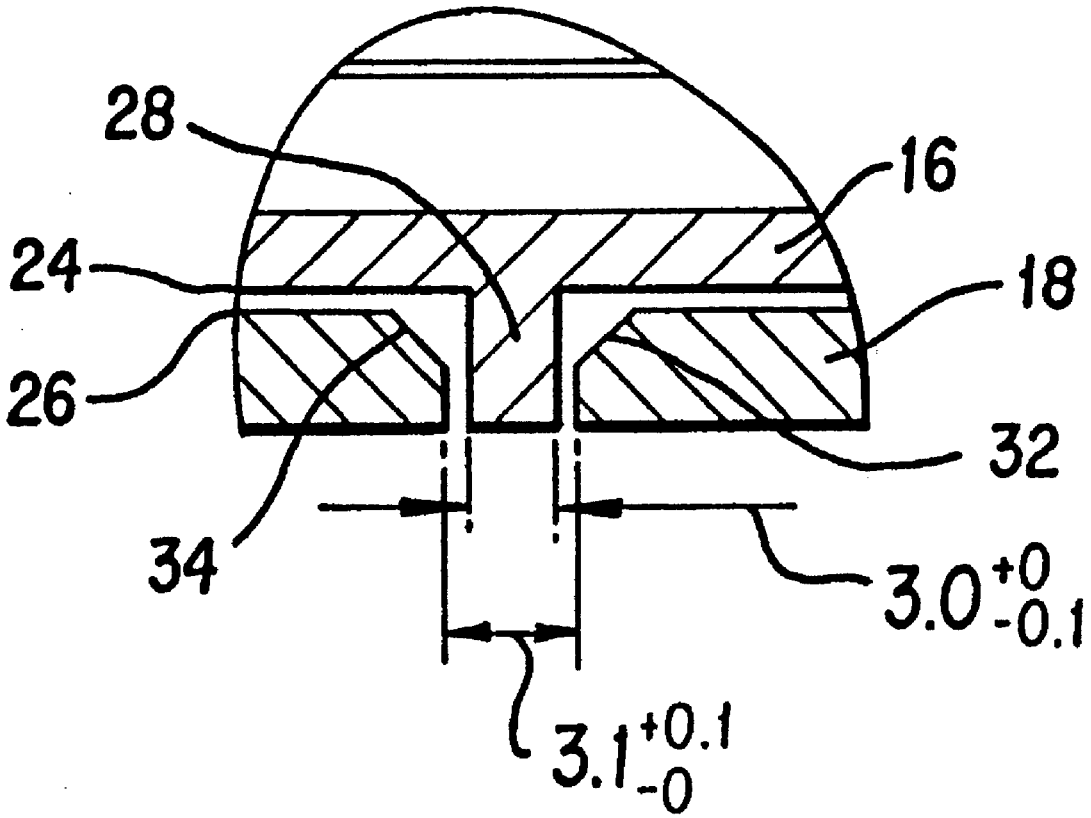
FIG. 5 is a cross-sectional view showing the engagement and the dimensions between the positioning projection and the slot.

FIG. 5 shows a cross-sectional view of the display panel 16 and the upper chassis 18 in the assembled position. The projection 28 is received within the slot 30. In addition, the upper chassis 18 includes guiding grooves 32 and 34 for facilitating entry of the projection 28 into the slot 30 during assembly. The projection 28 molded to have a width in the range of about 2–30 mm. If the width is less than 2 mm, the projection 28 may not be strong enough to withstand axial forces to prevent rattling. If the width is greater than 30 mm, it difficult and expensive to mold the projection 28 with high accuracy. In addition, the slot 30 has a width about equal to the width of the projection 28 plus no more than 0.3 mm. In other words, a clearance between the projection 28 and the slot 30 is no greater than 0.3 mm in order to ensure that rattling is substantially prevented. For example, the projection 28 can be manufactured to be integral with the display cover 16 and can have a width equal to about 3.0 mm with an acceptable tolerance of –0.1 mm. The slot 30 is formed to have a width of about 3.1 mm with an acceptable tolerance of +0.1 mm. While the panel 16 and chassis 18 are formed of molded plastic, which is difficult to mold to precise dimensions due to the large size of the panel 16 and chassis 18, the projection 28 and slot 30 are relatively easy to mold to precise dimensions.

Accordingly, this invention eliminates rattling between the display panel 16 and upper chassis 18. Because only very small parts are required to be manufactured with a high tolerance, molding and manufacturing costs are very low. In addition, because the positioning elements (comprising, for example, projection 30 and slot 28) are integrally formed on the first engagement surface 24 and the second engagement surface 26, respectively, assembly costs are reduced because there is no need to provide separate members, such as the washers and spring mechanisms of the prior art.

While, in the above described embodiment, the second engagement surface 26 and the slot 30 are shown as being provided in the upper chassis member 18, the second engagement surface 26 and the slot 30 may be provided on other chassis members of the typewriting machine. Furthermore, the slot 30 may be formed on the display panel 16, and the projection may be provided on the chassis or body 18. In addition, the positioning element is not limited for use for typewriters having rotatable display panels. For example, the positioning element could be applied to any relatively rotating members that require the prevention of relative axial movement while providing positioning and guidance throughout an entire rotatable range of relatively rotating elements.

While a preferred embodiment has been described, such description is for illustrative purposes only, and it will be understood that various changes may be made therein to embody the invention without departing from the spirit of the invention as set forth in the following claims.

What is claimed is:

1. A typewriter comprising:

a chassis;

a display panel pivotably connected to said chassis such that the display panel is rotatable between first and second angular positions that define a rotatable range; and a positioning element that is substantially centrally located along and between said display panel and said chassis, said positioning device being adapted to substantially prevent relative axial movement between the chassis and the display panel in said rotatable range, wherein the positioning element comprises a projection mounted on a first member of the chassis and the display panel and a slot provided within a second member of the chassis and the panel, and wherein the projection comprises an elongated arcuate segment and the slot comprises an elongated arcuate slot.

2. The typewriter of claim 1, wherein the projection and the first member comprise an integrally molded, unitary member, and the slot and the second member comprise an integrally molded, unitary member.

3. The typewriter of claim 1 further comprising a pin in a pin hole assembly arranged to rotatably mount the display panel to the chassis.

4. A typewriter comprising:

a chassis;

a display panel pivotably connected to said chassis such that the display panel is rotatable between first and second angular positions that define a rotatable range; and a positioning element that is substantially centrally located along and between said display panel and said chassis, said positioning device being adapted to substantially prevent relative axial movement between the chassis and the display panel in said rotatable range, wherein the display panel includes a first surface and the chassis includes a second surface generally matched in shape to and relatively rotatable with respect to the first surface, and wherein the positioning element comprises a projection mounted on the first surface, the positioning element further comprising a slot provided within the second surface, and further wherein the projection comprises an elongated arcuate segment formed on a generally matching arcuate segment of said first surface, and the slot comprises an elongated arcuate slot formed within a generally matching arcuate portion of said second surface, and further wherein rotary movement between the display panel and the chassis causes relative rotational movement between said first surface and said second surface, and the elongated arcuate segment is guided and maintained within said elongated arcuate slot throughout said rotatable range when adjusting the display panel to a desired viewing position.

5. A positioning mechanism for use with a display panel rotatably mounted to a body of a word processor, said positioning mechanism comprising:

a first surface formed on said display panel;

a second surface formed on said body, said first and second surfaces being relatively rotatable;

a positioning projection formed on the first surface; and a slot formed within the second surface, wherein the first surface is rotated with respect to the second surface thereby causing the positioning projection to travel along the slot, said positioning projection remaining disposed within the slot during an entire rotatable range of angular movement between open and closed positions, and wherein the positioning projection comprises an elongated arcuate section and said slot comprises an elongated arcuate receiving groove sized and dimensioned to accommodate said elongated arcuate section throughout said entire rotatable range.

6. The positioning mechanism of claim 5, further comprising an axis, said first surface and said positioning projection rotating about said axis.

7. The positioning mechanism of claim 6, further comprising a pin and slot assembly located at each end of the display panel, each said pin rotating about said axis.

8. The positioning mechanism of claim 5, wherein the positioning projection has a width equal to about 2–30 mm and the slot has a width about equal to the width of the positioning projection plus no more than 0.3 mm.

9. The positioning mechanism of claim 5, wherein the projection and the first surface comprise an integrally molded, unitary member, and the slot and the second surface comprise an integrally molded, unitary member.

10. A mechanism for positioning and guiding a display cover that is pivotable about a chassis, said mechanism comprising:

a pin associated with each end of a display cover;

a pin receiving hole associated with each side of a chassis, the pins and the pin receiving holes being slidably rotatable with respect to one another so as to allow the display cover to pivot about the chassis between a rotatable range defined by first and second positions; and means for substantially preventing axial movement between the pins and the pin receiving holes in said rotatable range, said means for substantially preventing axial movement being substantially centrally located along and between said display cover and said chassis, wherein the means for substantially preventing axial movement comprises a projection formed on a first surface formed on a first member of said display cover and said chassis, and a slot formed on a second surface formed on a second member of said display cover and said chassis, the slot being registrable with the projection in said rotatable range, and wherein the projection comprises an elongated arcuate segment formed on the display cover and the slot comprises an elongated arcuate slot formed on the chassis.

11. The mechanism of claim 10, wherein the projection and the first member comprise an integrally molded, unitary member, and the slot and the second member comprise an integrally molded, unitary member.

12. The mechanism of claim 10, wherein the means for substantially preventing relative axial movement includes means for preventing the display cover from rotating beyond a predetermined limit.

13. The mechanism of claim 12, wherein the means for preventing rotational movement comprises a said projection and a said slot, the slot having an abutment dimensioned so as to engage said projection at said predetermined limit.

* * * * *